US006611989B2

(12) United States Patent
Oh et al.

(10) Patent No.: US 6,611,989 B2
(45) Date of Patent: Sep. 2, 2003

(54) VACUUM CLEANER HAVING COOLING FEATURES

(75) Inventors: Dong Yeop Oh, Seoul (KR); Sang Wook Hong, Seoul (KR); Yong Dol Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/921,907

(22) Filed: Aug. 6, 2001

(65) Prior Publication Data

US 2002/0032947 A1 Mar. 21, 2002

(30) Foreign Application Priority Data

Sep. 19, 2000 (KR) ..... 20-2000-54845
Nov. 28, 2000 (KR) ..... 20-2000-71306

(51) Int. Cl.[7] ..... A47L 9/26
(52) U.S. Cl. ..... 15/323; 15/326; 15/327.7; 15/412
(58) Field of Search ..... 15/323, 326, 412, 15/327.7, 413

(56) References Cited

U.S. PATENT DOCUMENTS 2,272,985 A * 2/1942 Smith ..... 15/326
3,381,329 A * 5/1968 Wied ..... 15/323
3,458,891 A * 8/1969 Grellsson ..... 15/323
3,695,006 A * 10/1972 Valbona et al. ..... 15/412
3,866,263 A * 2/1975 Crouser et al. ..... 15/412
4,533,370 A * 8/1985 Ikezaki et al. ..... 15/326
4,547,927 A * 10/1985 Berfield ..... 15/412
5,513,417 A * 5/1996 Kim et al. ..... 15/326
6,070,289 A * 6/2000 Lee et al. ..... 15/326
6,336,244 B1 * 1/2002 Tarutani et al. ..... 15/326

FOREIGN PATENT DOCUMENTS

DE 27 24 249 A 11/1978
DE 30 42 894 A 5/1982
DE 196 16 156 C 10/1997
GB 1 504 063 A 3/1978
JP 04 303407 A 10/1992

* cited by examiner

*Primary Examiner*—Theresa T. Snider
(74) *Attorney, Agent, or Firm*—Birch, Stewart, Kolasch & Birch, LLP

(57) ABSTRACT

A vacuum cleaner has a case including a dust chamber filtering dust included in air, an appliance chamber sucking the filtered air from the dust chamber and discharging the air through a discharge port, and a cord chamber storing a wound electrical cord. A fan motor assembly is installed inside the appliance chamber of the case for forcedly sucking the air inside the appliance chamber and discharging the air. An exhaust duct is installed between the fan motor assembly and the discharge port in the case and guiding the air discharged from the fan motor assembly to the discharge port, and a flowing passage is disposed between the dust chamber and the cord chamber so that the air is able to flow therein, whereby overheating of case and of the electrical cord can be prevented and the durability and reliability of the cleaner can be enhanced.

6 Claims, 7 Drawing Sheets

VACUUM CLEANER HAVING COOLING FEATURES

BACKGROUND OF THE INVENTION

1. Field of the Invention

The present invention relates to a vacuum cleaner, and particularly, to a vacuum cleaner in which an appliance chamber forming a suction force and a cord chamber for storing and winding an electrical cord are included.

2. Description of the Background Art

Generally, a vacuum cleaner is an appliance for removing foreign materials such as dirt, dust and debris using a strong suction force generated by operation of a fan motor assembly.

A conventional vacuum cleaner, as shown in FIG. 1, includes a case 10 in which a suction head 1, an extension tube 3, and a suction hose 5 are connected in series so as to suck up the foreign materials such as dust therethrough.

In addition, a dust chamber 12 including a dust bag 20 for collecting the foreign materials such as dust included in the sucked air is disposed at the inner front side of the case 10, and an appliance chamber 13 generating suction force and a cord chamber 14 for storing a wound electrical cord are disposed to the rear of the dust chamber 12 parting inside the case.

A suction port 15 communicating with the dust chamber 12 is formed in a front part of the appliance chamber 13, a fan motor assembly 30 for generating the suction force is installed to the rear of the suction port 15, and a discharge port 16 for discharging therethrough the sucked air to the outside of the case 10 is installed at the rear side of the fan motor assembly 30. In addition, an exhaust filter 17 is installed at the discharge port 16.

A cord reel 42 for winding the electrical cord 41 is installed in the cord chamber 14, and the cord reel 42 is rotated on a reel axle shaft 40 supported inside of the case 10.

The structure of the appliance chamber and core chamber in the conventional vacuum cleaner will now be described, with reference to FIGS. 2 through 7.

FIG. 2 is a side cross-sectional view taken along line A—A in FIG. 1, and showing the internal structure of the appliance chamber, and FIG. 3 is an exploded perspective view showing the fan motor assembly installed in the appliance chamber shown in FIG. 2.

As shown in FIGS. 2 and 3, the fan motor assembly 30 installed in the appliance chamber 13 includes a driving motor 31 having a rotating shaft 32; a centrifugal fan 34 installed on the rotating shaft 32 of the driving motor 31; a guide vane wheel 35 installed between the driving motor 31 and the centrifugal fan 34 and guiding the air discharged from the centrifugal fan 34 to the driving motor 31 through a plurality of vanes 35*a* and an opening hole 35*b* in the central part thereof; and a fan cover 36, in which the centrifugal fan 34 and the guide vane 35 are enclosed, communicating with the suction port 15 communicated with the dust chamber 12.

Herein, a motor housing 33 including a stator and a rotor is installed in the driving motor 31, and an inlet port 33*a* for introducing the air discharged through the opening hole 35*b* of the guide vane 35 is disposed in a front side of the motor housing 33. In addition, an exhaust port 33*b* for discharging the air sucked inside the housing 33 to the appliance chamber 13 is formed in a peripheral surface of the housing 33.

In addition, the peripheral surface of the motor housing 33 is covered by an acoustically absorbent sleeve 38 made of a multiperforated film, whereby the outside of the exhaust hole 33*b* is covered, and at the same time, the noise generated when the air is discharged from the motor housing 33 is reduced.

FIG. 4 is a side cross-sectional view taken along line B—B in FIG. 1, showing the inner structure of the cord chamber, and FIG. 5 is a plan view showing the cord reel installed in the cord chamber in FIG. 4.

As shown in FIG. 4, a cord passage hole 19 is formed in the cord chamber 14 on rear side of the case 10 so that the electrical cord can be drawn therethrough, and the cord reel 42 including a hub 43 and reel flanges 44 is installed inside the cord chamber 14 so that the electrical cord 41 can be wound thereonto.

The cord reel 42 is installed to be rotational on the reel axle shaft 40 so that the electrical cord 41 is able to be wound or unwound.

Herein, heat is generated in the electrical cord 41 while operating the vacuum cleaner, and especially, as vacuum cleaners having strong suction force using motors of high-efficiency and high-energy are developed, more heat is generated in the electrical cord 41.

Also, as the size of the vacuum cleaners is becoming smaller than before, consequently the internal space available for storing the electrical cord 41 becomes smaller. Therefore, the electrical cord 41 must be wound more densely on the cord reel 42 and smaller gauge cords may be adopted, whereby the heating value per unit volume is increased, and accordingly, the temperature of the electrical cord 41 approaches to the safety threshold level.

Therefore, in order to prevent the rising of the temperature in the electrical cord 41, a plurality of cooling holes 43*a* and 44*a* through which the air passes are formed in the cord reel 42 so that the electrical cord 41 may be cooled through heat exchange with the air flowing thereover and therethrough smoothly, as shown in FIG. 7.

The conventional vacuum cleaner having the structure including the appliance chamber 13 and the cord chamber 14 as described above is operated as follows.

First, in order to operate the vacuum cleaner, electrical power must be supplied to the vacuum cleaner, and accordingly, a user draws out the electrical cord 41 wound on the cord reel 42 inside the cord chamber 14 to a certain length, and inserts a plug disposed on end of the electrical cord 41 into a wall electric outlet so that the electric current is able to be supplied to the vacuum cleaner.

When the electric current is applied to the vacuum cleaner, the driving motor 31 is operated, and the centrifugal fan 34 inside the appliance chamber 13 rotates, whereby foreign materials such as dust are sucked with the air into the dust bag 20 through the suction head 1 and suction hose 5 by the suction force of sucking the air inside the dust chamber 12.

As described above, the air sucked inside the dust bag 20 flows toward the appliance chamber 30 by the continuing suction operation of the fan motor assembly. At that time, the foreign materials such as dust included in the air are left inside the dust bag 20 by filtering, and the air passing through the dust bag 20 is sucked into the appliance chamber 30, and after that, the air is discharged outside of the vacuum cleaner through the discharge port 16 in the case 10.

The flowing process of the air inside the appliance chamber 30 will now be described. The air sucked through the suction port 15 between the dust chamber 12 and the appliance chamber 13 enters into the centrifugal fan 34 through the suction port 36*a* in the fan cover 36. And the air passed through the centrifugal fan 34 flows toward the center from the peripheral surfaces of the guide vanes 35, and after that the air is sucked into the motor housing 33 through the opening hole 35*b* in the center of the guide vane 35.

The air entering into the motor housing 33 cools down the motor parts such as the stator and the rotor, and after that, the air is discharged into the inside of the case through the exhaust port 33*b* in the motor housing 33. Then, the air is discharged to the outside through the exhaust filter 17 and through the discharge port 16 of the case 10, as long as the vacuum cleaner is operated.

However, the conventional vacuum cleaner described above has problems, such that the air heated while going through the fan motor assembly 30 is discharged directly to the appliance chamber 13 through the exhaust port 33*b*, after that, the air is discharged outside the case 10. Therefore, the case 10 may be distorted by the heated air discharged from the fan motor assembly 30.

That is, the air entering into the fan motor assembly 30 from the dust chamber 12 is heated while going through the centrifugal fan 34 rotating at high speed and being compressed, and it is heated again inside the driving motor 31, and accordingly the temperature of the air discharged from the fan motor assembly 30 is very high. On the contrary, the case 10 forming the appliance chamber 13 is generally made using a synthetic resin material, and therefore the high temperature air discharged from the fan motor assembly 30 directly contacts the case 10 , and the case 10 may be distorted by the high temperature air if the cleaner is used for a long time.

Also, in the conventional vacuum cleaner described above, the cord chamber 14 in which the electrical cord 41 is wound and stored has a closed structure except for the cord pass hole 19 for passing the electrical cord 41, and thereby the temperature in the cord chamber 14 is risen in accordance with the heat generation in the electrical cord 41.

That is, as shown in FIG. 7, the heat generated from the electrical cord 41 while using the vacuum cleaner flows to an upper part of the cord chamber 14, and remains therein, whereby the gap in the temperature between the upper part and lower part oil the cord chamber 14 is about 26° C. In addition, as the temperature in the cord chamber 14 rises, the temperatures of the electrical cord 41 and of the cord chamber 14 become nearly the same, and the electrical cord 41 is not cooling down well even if the cooling holes 43*a* and 43*b* are formed in the cord reel 43.

Therefore, given the problems with the conventional vacuum cleaner having the structure described above, it is difficult to design a new model having a higher power output because the case 10 and the electrical cord 41 may be distorted by the heat generated from the fan motor assembly 30 and from the electrical cord 41. Moreover, if a heat-resistant coating agent is applied to the case 10 and the electrical cord 41 and/or the components are made using materials of sufficient heat resistance and durability, the production cost is increased.

SUMMARY OF THE INVENTION

Therefore, an object of the present invention is to provide a vacuum cleaner provided with a flowing guide for passing high temperature air installed between a fan motor assembly and a discharge port, and also with a flowing passage for cooling installed between a dust chamber and cord chamber, whereby overheating of the case and electrical cord may be prevented, and whereby the durability and reliability of the vacuum cleaner are enhanced.

To achieve the above objects of the present invention, there is provided a vacuum cleaner according to the invention which includes a case having a dust chamber for filtering dust from sucked-in air, an appliance chamber sucking the filtered air from the dust chamber and discharging it outside through a discharge port, and a cord chamber for storing a wound electrical cord, these chambers being separated from one another; a fan motor assembly installed inside the appliance chamber of the case for forcedly sucking in and discharging air into the inside of the dust chamber; an exhaust duct means installed between the fan motor assembly and the exhaust port in the case and guiding the air discharged through the fan motor assembly to the exhaust port; and a flowing passage means disposed between the dust chamber and the cord chamber so that the air is able to flow inside the cord chamber.

Also, to achieve the objects of the present invention, there is provided a vacuum cleaner which includes a case in which are installed a dust chamber for filtering dust included in sucked-in air, and an appliance chamber sucking the filtered air in the dust chamber and discharging the air outside the case through a discharge port; a fan motor assembly installed inside the appliance chamber in the case and forcedly sucking and discharging the air inside the dust chamber; and a discharge duct installed between the fan motor assembly and the discharge port in the case and guiding the air discharged through the fan motor assembly to the discharge port.

Further, to achieve the objects of the present invention, there is provided a vacuum cleaner which includes a case in which a dust chamber for filtering dust included in suckered air, and a cord chamber having a cord pass through hole in one side and storing a wound electrical cord are installed separated from each other; and at least one flowing passage is provided between the dust chamber and the cord chamber so that air is able to flow therebetween.

The foregoing and other objects, features, aspects and advantages of the present invention will become more apparent from the following detailed description taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
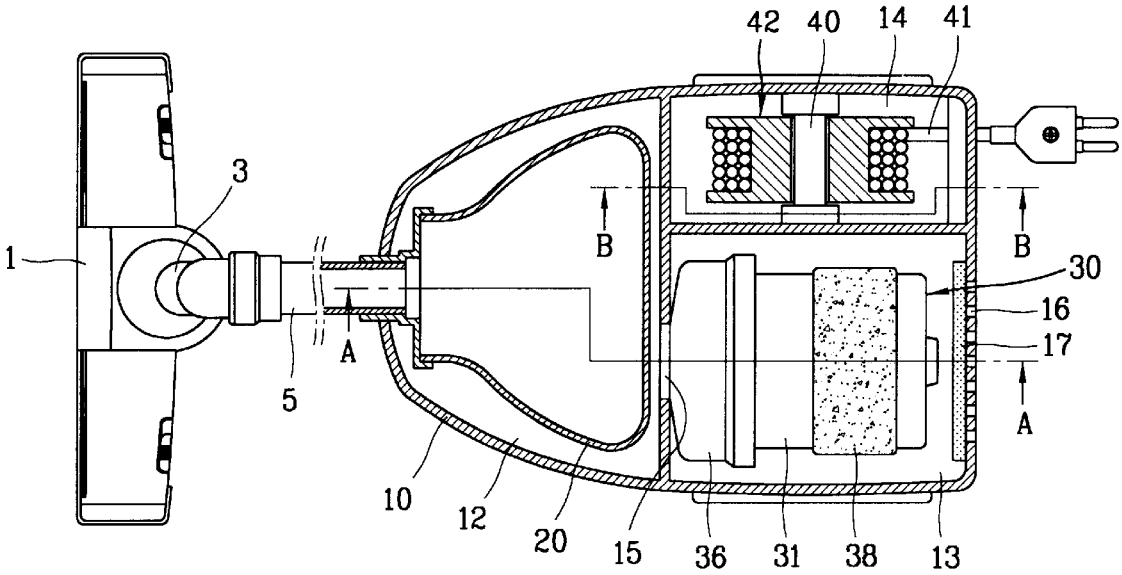
FIG. 1 BACKGROUND ART
FIG. 1 is a transverse cross-sectional view showing a conventional vacuum cleaner.
Figure 2:
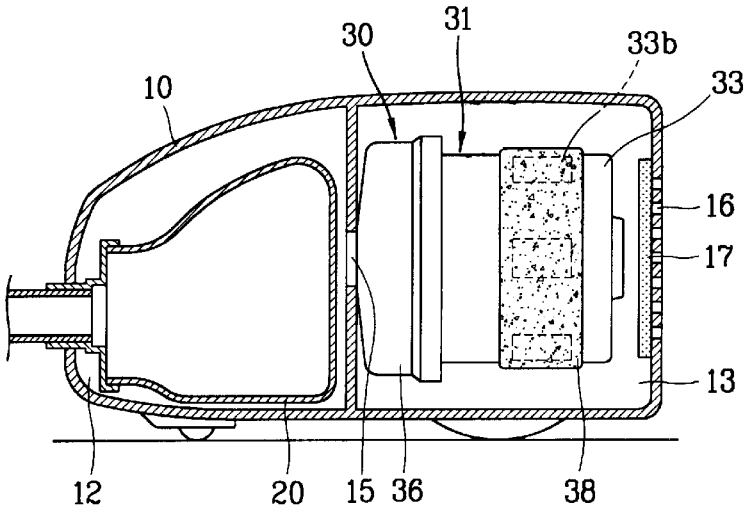
FIG. 2 BACKGROUND ART
FIG. 2 is a side cross-sectional view taken along the line A—A in FIG. 1 and showing the inner structure of an appliance chamber of the conventional vacuum cleaner.
Figure 3:
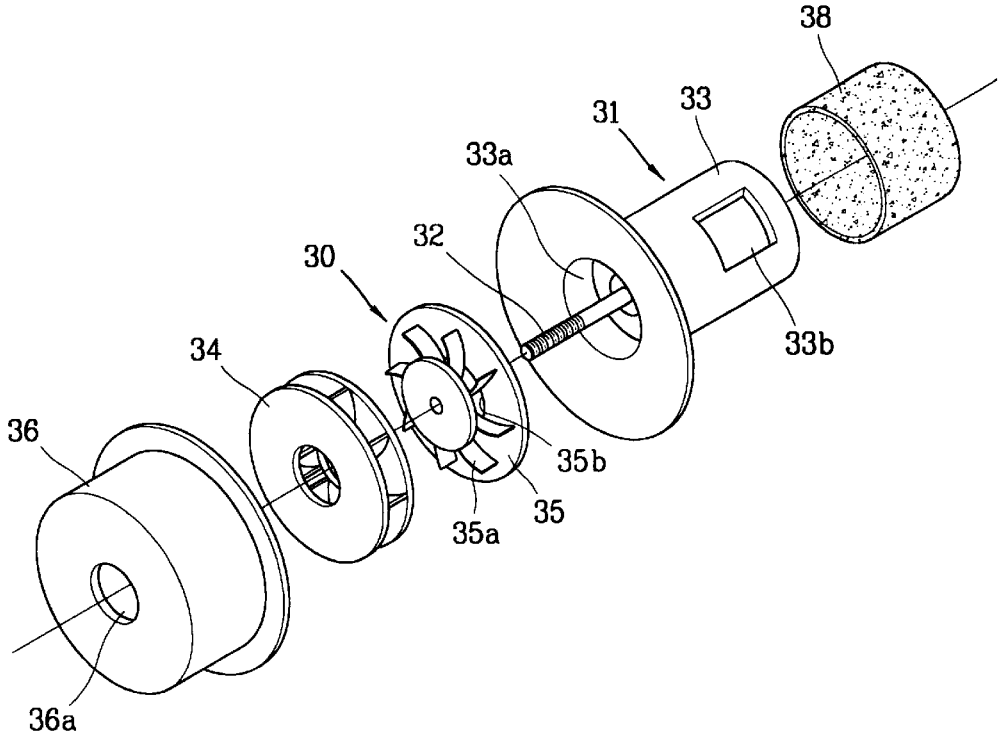
FIG. 3 BACKGROUND ART
FIG. 3 is an exploded perspective view showing a fan motor assembly in the appliance chamber shown in FIG. 2 and showing an air flowing state therethrough.
Figure 4:
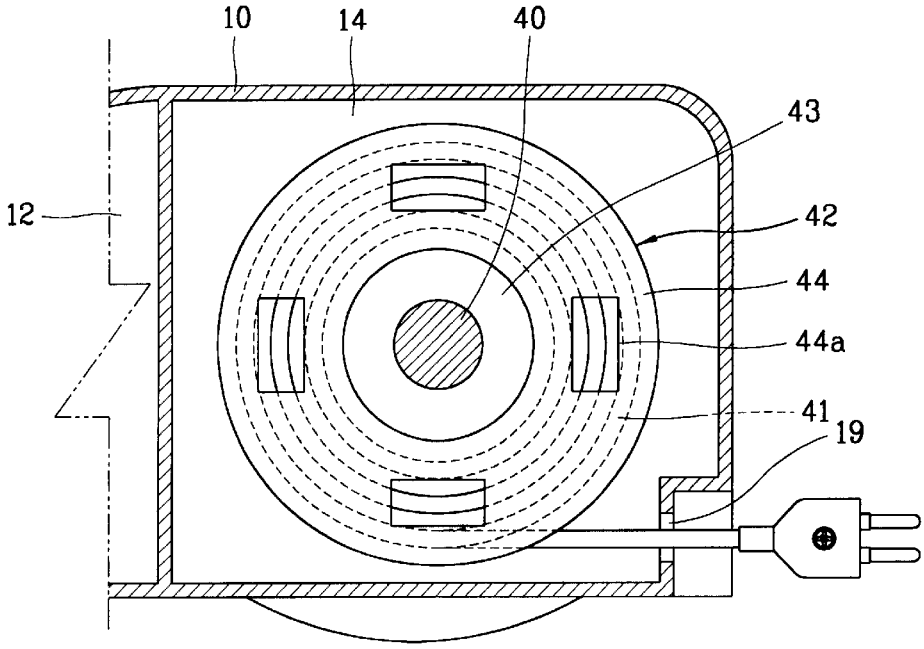
FIG. 4 BACKGROUND ART
FIG. 4 is a side cross-sectional view taken along the line B—B in FIG. 1 and showing the inner state of a cord chamber in the conventional vacuum cleaner.
Figure 5:
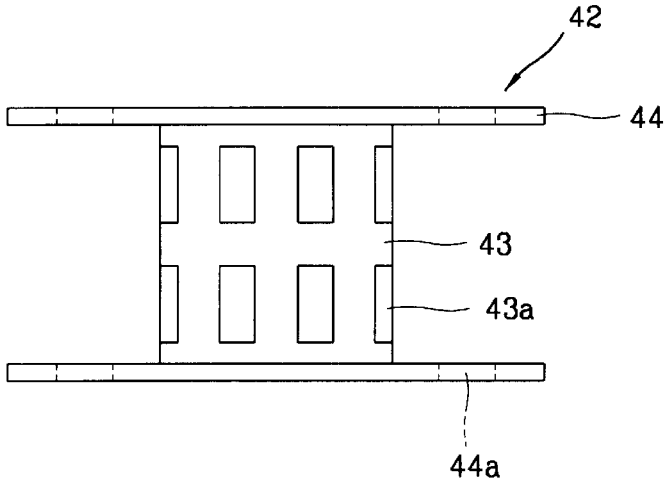
FIG. 5 BACKGROUND ART
FIG. 5 is a plan view showing a cord reel installed inside the cord chamber shown in FIG. 4.
Figure 6:
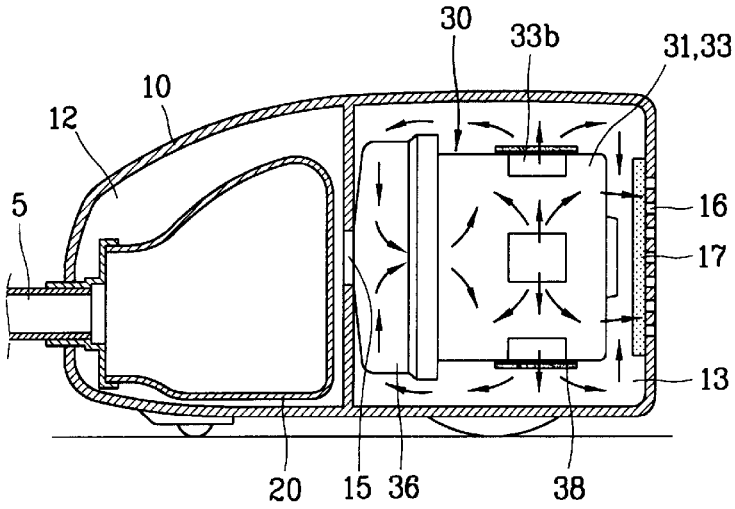
FIG. 6 BACKGROUND ART
FIG. 6 is a drawing showing an air flowing state in the appliance chamber of the conventional vacuum cleaner.
Figure 7:
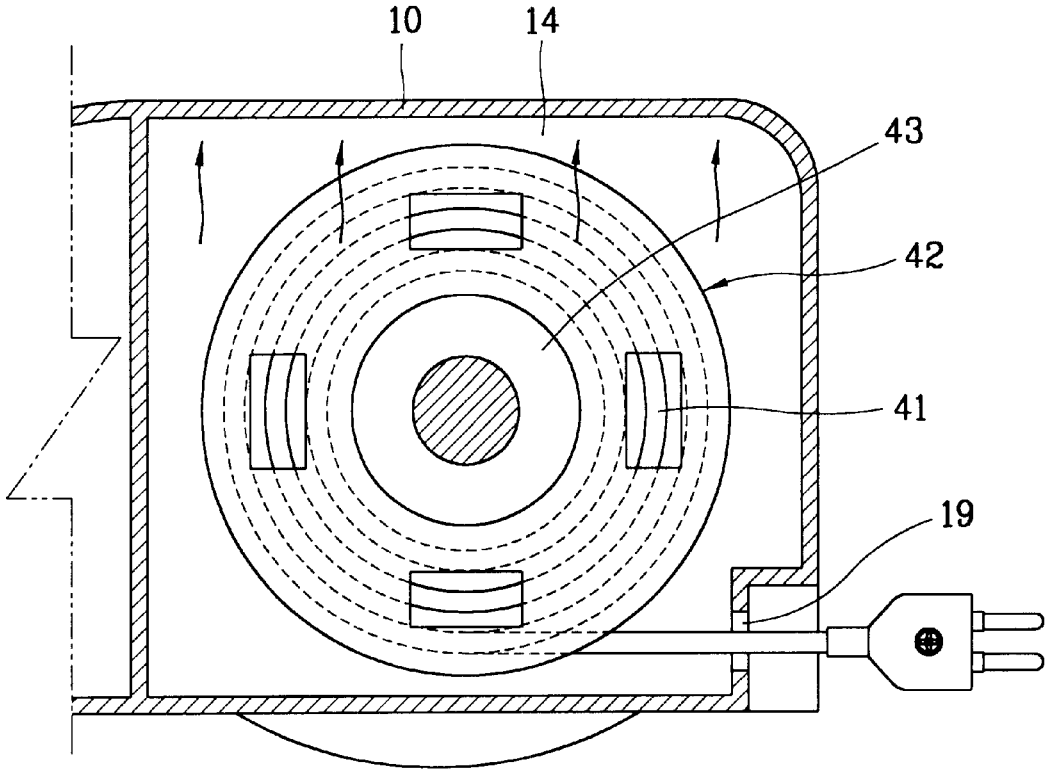
FIG. 7 BACKGROUND ART
FIG. 7 is a drawing showing an air flowing state in the cord chamber of the conventional vacuum cleaner.
Figure 8:
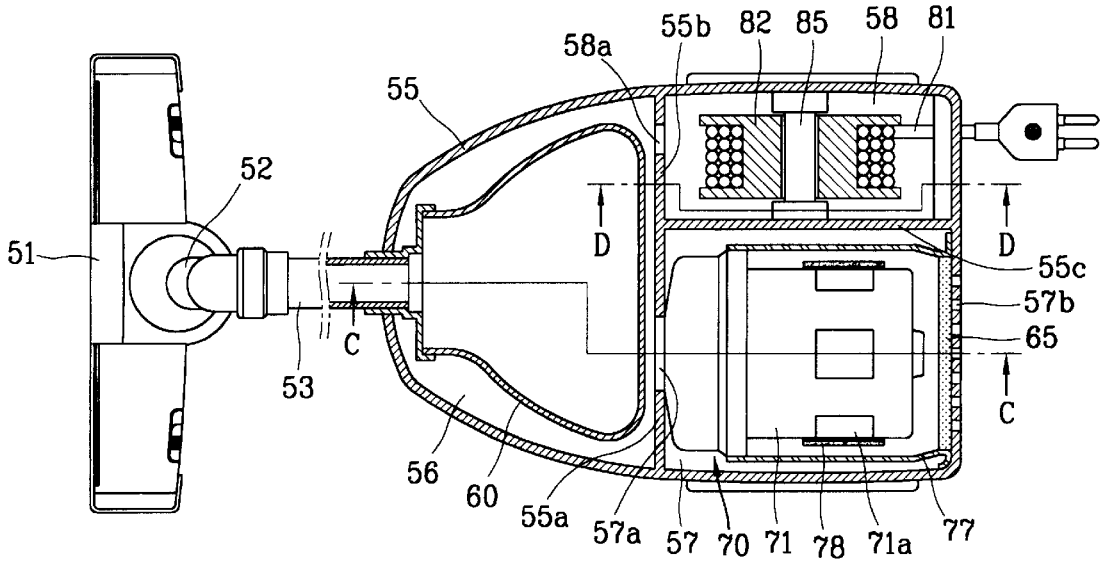
FIG. 8 is a transverse cross-sectional view illustrating a vacuum cleaner in accordance with the present invention.

FIG. 8 is a transverse cross-sectional view illustrating a vacuum cleaner in accordance with the present invention.

As shown in FIG. 8, the vacuum cleaner according to the present invention includes a suction head 51, an extension tube 52, and a suction hose 53 connected with each other and coupled to a front side of the case 55 so as to suck dust there into.

The case 55 includes a dust chamber 56 having a dust bag 60 for filtering dust included in sucked-in air, an appliance chamber 57 sucking the filtered air in the dust chamber 56 and discharging it outside through a discharge port 57*b*, and a cord chamber 58 storing a wound electrical cord 81, these chamber 56, 57 and 58 being separated by respective parting walls 55*a*, 55*b* and 55*c*.

The dust chamber 56 is located in the front portion of the case 55, and the appliance chamber 57 and the cord chamber 58 are disposed in the rear portion of the case 55 behind the dust chamber 56 and separated by the partition wall 55*c*.

Figure 9:
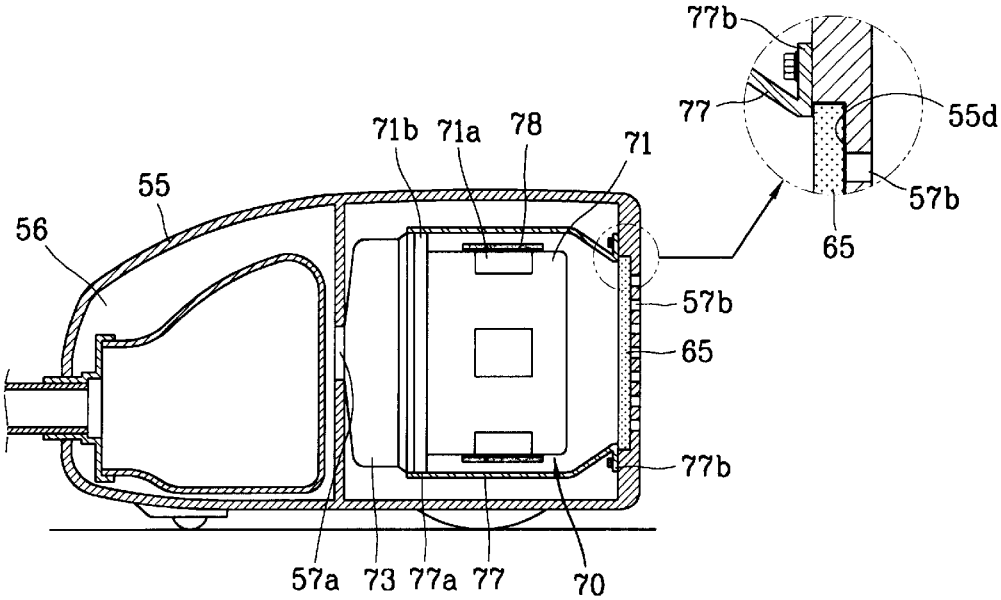
FIG. 9 is a side cross-sectional view taken along the line C—C in FIG. 8 showing the inner structure of an appliance chamber in the vacuum cleaner of the present invention.

FIG. 9 is a side cross-sectional view taken along the line C—C in FIG. 8 showing the inner structure of the appliance chamber 57.

As shown in FIG. 9, a suction port 57*a* communicated to the dust chamber 56 is formed in the partition wall 55*a* in the front of the appliance chamber 57. The fan motor assembly 70 is installed at the rear side of the suction port 57*a* for generating a suction force therethrough, and the discharge port 57*b* is installed at the rear side of the fan motor assembly 70 so that the sucked-in air is able to be discharged therethrough outside the case 55.

The fan motor assembly 70 includes a driving motor (not shown) and a centrifugal fan (not shown) so as to forcedly suck the air from inside the dust chamber 56 and discharge the air as described above. The driving motor is installed in a motor housing 71, and the centrifugal fan is installed inside a fan cover 73 and is rotated by the driving motor.

Herein, a front central part of the fan cover 73 is in communication with the suction port 57*a* which is, in turn, in communication with the dust chamber 56, and a plurality of discharge ports 71*a* are formed in a peripheral part of the motor housing 71 so that the air sucked into the fan cover 73 is able to be discharged therethrough.

In addition, an exhaust filter 65 is installed over the discharge port 57*b* of the appliance chamber 57 so as to filter the discharged air, and a recessed filter holder 55*d* is formed in the rear wall of the case 55 so as to receive the exhaust filter 65.

A generally cylindrical exhaust duct 77 is installed around the fan motor assembly 70 to provide a flow path between the fan motor assembly 70 and the discharge port 57*b* in the case 55 for guiding the air discharged through the exhaust ports 71*a* in the motor housing 71 to the discharge port 57*b* in the case 55.

The exhaust duct 77 extends from the edge of a flange 71*b* where the fan cover 73 and the motor housing 71 are coupled, that is, from the periphery of the fan motor assembly 70 to the filter holder 55*d* where the exhaust filter 65 is installed, whereby an air flowing passage is formed between the fan motor assembly 70 and the case 55.

That is, the exhaust duct 77 has a generally cylindrical form having a larger inner diameter than the outer diameter of the motor housing 71, and a front end part 77*a* of the exhaust duct 77 is fixed to the flange 71*b* of the fan motor assembly 70, while a rear end part 77*b* of the exhaust duct 77 is fixed around and over the filter holder 55*d* of the case 55 as shown in more detail in the enlarged partial view in FIG. 9.

Here, it is desirable that the end part of the exhaust duct 77 which communicates to the filter holder 55*d* with the motor housing 71 is made smaller or larger in accordance with the size of the discharge port 57*d*.

In addition, it is desirable that an acoustically absorbent sleeve 78 or the like made of a multiperforated film or foam is installed around the periphery of the motor housing 71 located inside the discharge duct 77 to reduce the noise generated when the sucked-in air is discharged.

Figure 10:
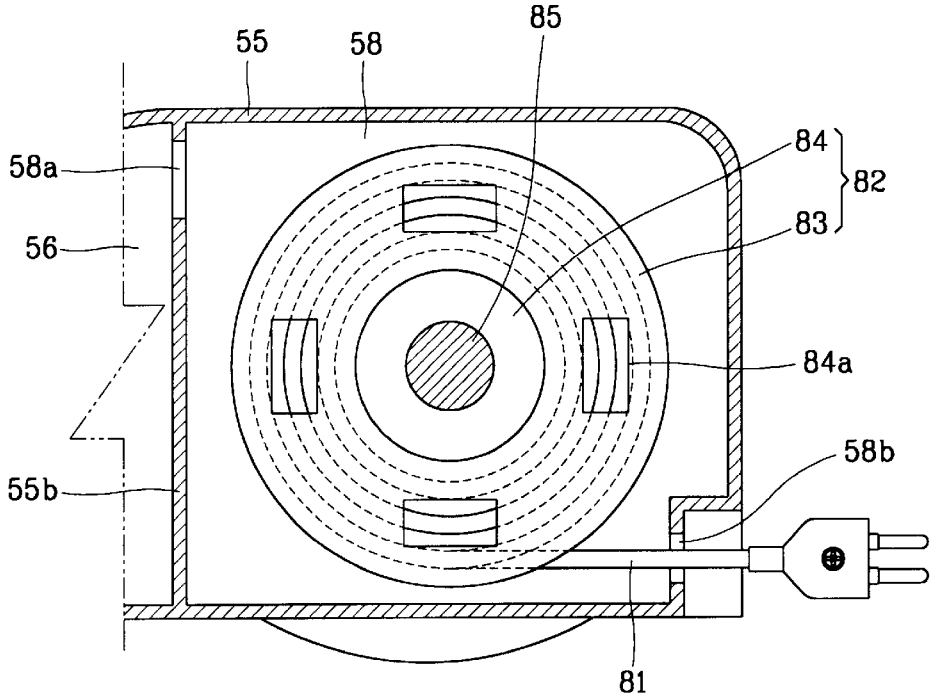
FIG. 10 is a side cross-sectional view taken along the line D—D in FIG. 8 showing the internal structure of a cord chamber in the vacuum cleaner of the present invention.

FIG. 10 is a side cross-sectional view taken along the line D—D in FIG. 8, showing the internal details of the cord chamber.

As shown in FIG. 10, the cord chamber 58 includes a cord passage hole 58*b* formed in the rear wall of the case 55 so that the electrical cord 81 can be drawn therethrough, and a cord reel 82 including reel flanges 83 and a hub 84 is mounted inside the cord chamber 58 so that the electrical cord can be wound thereon.

The cord reel 82 rotates on a reel axle shaft 85 supported inside the case 55, and a plurality of cooling holes 84*a* through which air can be passed are provided in the reel flanges 83 and the hub 84 so as to cool down the electrical cord 81.

In the partition wall 55*b* between the dust chamber 56 and the cord chamber 58, at least one cooling port 58*a* is formed so that the high temperature air generated inside the cord chamber 58 is able to be discharged to the dust chamber 56.

The cooling port 58*a* is formed in the upper part of the cord chamber 58 so as to be communicated with the dust chamber 56, so that the high temperature air can be easily discharged, and the cord passage hole 58*b* is disposed in a lower part of the cord chamber 58 so that the outer air can enter into the inside.

In addition, the cooling port 58*a* and the cord passage hole 58*b* are so formed as to be located on the opposite ends of the cord chamber 58 from each other, and it is desirable that the sectional area of the cooling port 58*a* is not more than 20 $mm^2$.

Also, the cooling port 58*a* can be formed as a round, square or variously shaped opening in accordance with the conditions.

Also, when the dust chamber 56 and the cord chamber 58 are provided within a certain distance from each other and are not separated by a partition wall, an extension pipe or duct of a certain length can be installed so that the air inside the cord chamber is able to flow to the dust chamber.

The operation of the vacuum cleaner according to the present invention will now be described with reference to FIG. 8.

When a user draws out the electrical cord 81 stored in the cord chamber 58 to a certain length and inserts a plug of the electrical cord 81 into a wall outlet, electric power is supplied to the vacuum cleaner.

In the state that electric power is supplied to the vacuum cleaner, when the power switch is turned on, the driving motor inside the appliance chamber 57 is operated, whereby the centrifugal fan is rotated. At that time, dust from a cleaning area where the suction head is located enters into the dust bag 60 through the suction head 51 and the suction hose 52 by the suction force of the air inside the dust chamber 57 being sucked into the appliance chamber 57.

The air entering inside the dust chamber 60 flows to the appliance chamber 57 by the continued suction of the fan motor assembly 70. At that time, foreign materials such as dust are left in the dust bag 60, and the air filtered by passing through the dust bag 60 is sucked into the fan motor assembly 70, and then discharged inside the exhaust duct 77 through the exhaust ports 71*a* in the motor housing 71.

Herein, the filtered air being discharged into the exhaust duct 77 is compressed while passing through the centrifugal fan, and discharged into the exhaust duct 77 in a heated state where it expands while cooling down the driving motor.

The air discharged into the exhaust duct 77 is not contacted with the inner surface of the case 55 forming the appliance chamber 57, but is discharged directly to the outside through the discharge port 57*b* in the case 55 after passing through the exhaust filter 65.

Therefore, the heated air while passing through the fan motor assembly 70 and appliance chamber 57 is not contacted with the case 55, but is confined by and goes through the exhaust duct 77. Then the air is discharged outside through the discharge port 57*b* directly, whereby distortion of the case plastic due to the heated air is able to be prevented.

Also, the heated air discharged through the exhaust ports 71*a* of the motor housing 70 does not go through a complex or circuitous flowing passage during the process of flowing to the discharge port 57*b* of the case 55 as in the conventional art, but is discharged outside the case 55 through a short flowing passage formed by the exhaust duct 77, whereby the flowing of the air can be achieved in simple way.

On the other hand, the air inside the cord chamber 58 is heated by the heat generated from the electrical cord 81 wound on the cord reel 82, whereby the air density inside the cord chamber 58 is reduced and the air moves upward in the cord chamber 58.

At that time, external air is sucked into the cord chamber 58 through the cord passage hole located in the lower part of the cord chamber 58, and the heated air is discharged to the dust chamber 56 through the cooling port 58*a* located in the upper part of the cord chamber 58. Thereby the temperature inside the cord chamber 58 is lowered and over-heating of the electrical cord 81 can be prevented.

That is, the cooling port 58*a* is formed between the dust chamber 56 and the cord chamber 58, whereby the suction force generated in the appliance chamber 57 is also communicated to the cord chamber 58 through the dust chamber 56 and cooling port 58*a*. Therefore, air flows inside the cord chamber and cools in the cord chamber 58 including the electrical cord 81.

Even if the cooling port 58*a* formed between the dust chamber 56 and the cord chamber 58 is formed with a diameter of only 3.5 mm, the temperature of the electrical cord 81 wound in the cord chamber 58 is reduced by more than 15° C., as proven in an actual experiment.

Figure 11:
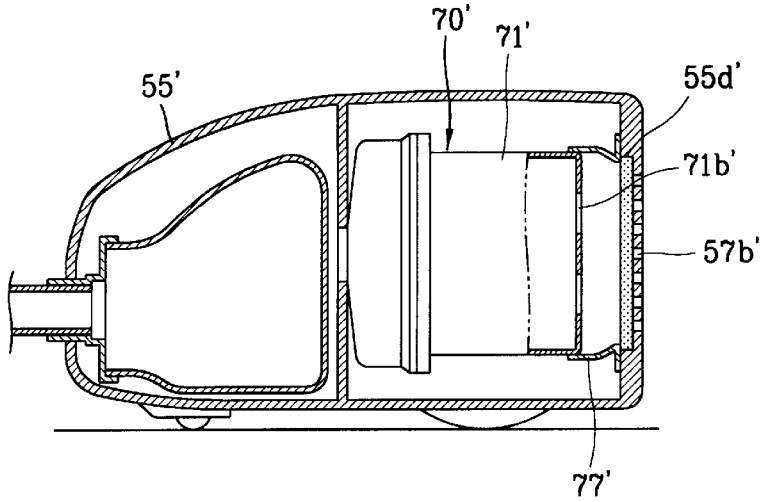
FIG. 11 is a side cross-sectional view showing the inner structure of an appliance chamber in a vacuum cleaner according to another embodiment of the present invention.

FIG. 11 is a side cross-sectional view showing the inner structure of an appliance chamber in a vacuum cleaner according to another embodiment of the present invention.

In the embodiment already described above, the discharge ports 71*b* in the fan motor assembly 70 are formed in a peripheral surface of the motor housing 71, whereas in this new embodiment discharge ports 71*b*' in a fan motor assembly 70' are formed in a rear surface of a motor housing 71'.

Therefore, in this second embodiment, a discharge duct 77' is extended from a rear edge surface of the motor housing 71' of the fan motor assembly 70' to a discharge port 57*b*' in the case 55', whereby the air discharged from the fan motor assembly 70' is guided to the discharge port 57*b*' by the exhaust duct 77'.

The exhaust duct 77' described above has a generally cylindrical form, and the inlet and outlet of the exhaust duct 77' are fixed on the motor housing 71' and over a filter holder 55*d*', respectively.

The heated air discharged from the fan motor assembly 70' is not contacted with the case 55', but is discharged directly outside through the exhaust duct 77' and the discharge port 57*b*', whereby distortion of the case 55' by the heated air is able to be prevented.

Also, the exhaust ports 71*b*' are formed in the rear side of the motor housing 71' facing toward the discharge port 57*b*' in the case 55', and the exhaust duct 77' is communicated between the exhaust ports 71*b*' and the discharge port 57*b*'. Therefore, the flow resistance against the air discharged from the fan motor assembly 70' is minimized, whereby the discharging efficiency can be increased. Accordingly, the suction force which greatly affects the function of the vacuum cleaner is able to be increased.

Figure 12:
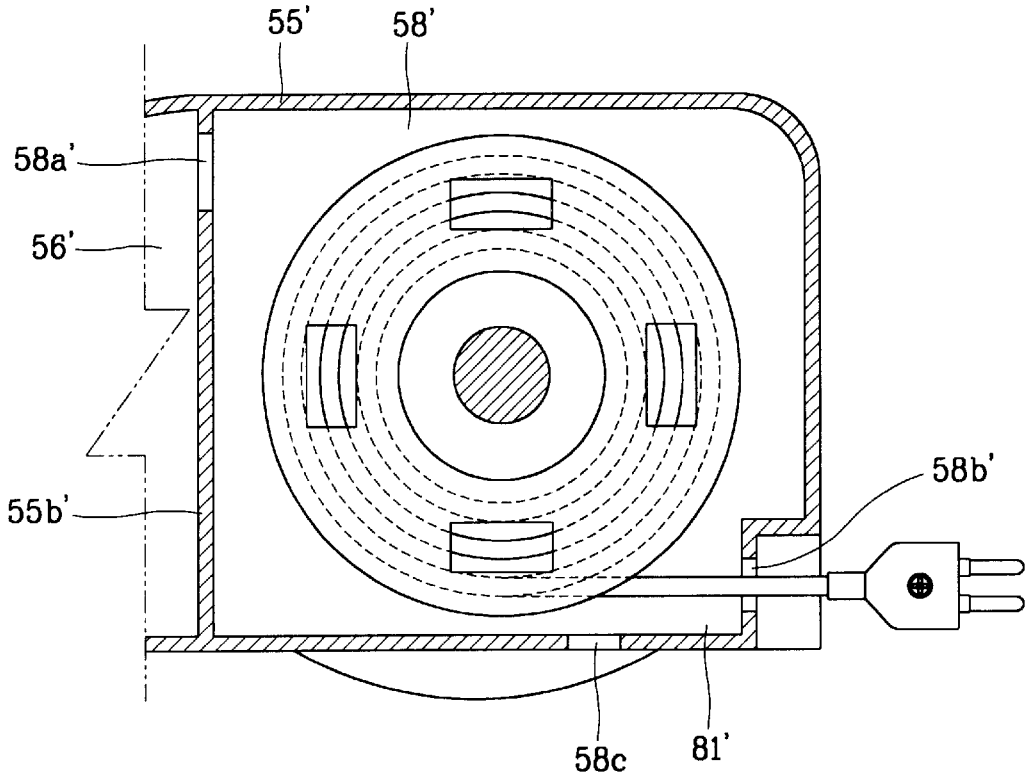
FIG. 12 is a side cross-sectional view showing the inner structure of a cord chamber in the vacuum cleaner according to still another embodiment of the present invention.

FIG. 12 is a side cross-sectional view showing the inner structure of a cord chamber in a vacuum cleaner according to still another embodiment of the present invention.

In the cord chamber 58' according to this further embodiment, a cord passage hole 58*b*' is formed in the rear of the case 55' so that an electrical cord 81' can be drawn therethrough. At least one cooling port 58*a*' is formed in a partition wall 55*b*' between the dust chamber 56' and the cord chamber 58' 50 that the high temperature air generated in the cord chamber 58' can be discharged to the dust chamber 56'.

In a lower part of the ease 55' forming the lower part of the cord chamber 58', an auxiliary port 58*c* communicated with the outside is formed.

Herein, the auxiliary port 58*c* can be formed as a round, square, or variously shaped opening.

On the other hand, the cooling port 58*a*' is formed in an upper part of the cord chamber 58' and communicates with the dust chamber 56'; so that high temperature air is able to be discharged smoothly therethrough.

As described above, if the auxiliary port 58*c* is formed in the lower part of the cord chamber 58', external air can be sufficiently sucked into the cord chamber 58' through the port 58*c* and the cord passage hole 58*b*', and therefore the electrical cord 81 is able to be cooled more efficiently.

In the vacuum cleaner according to the present invention, the air heated while passing through the fan motor assembly is directly discharged outside without contacting the case, and therefore even if the user operates the vacuum cleaner for a long time, distortion of the case caused by heated air discharged from the fan motor assembly is able to be prevented.

Also, the vacuum cleaner according to the present invention has a cooling port formed between the cord chamber and the dust chamber, whereby the electrical cord stored in the cord chamber is able to be cooled efficiently.

The vacuum cleaner according to the present invention is constructed to reduce or cool the heat generated from the fan motor assembly and from the electrical cord, whereby the distortion of the case and heating of the electrical cord can be prevented. Accordingly, use of higher cost materials with high heat resistance and high durability is not required, and thereby the product cost can be reduced and a vacuum cleaner with higher output is able to be provided.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A vacuum cleaner comprising:

a case having a dust chamber for filtering dust included in air, an appliance chamber communicating with the dust chamber, and a cord chamber for storing a wound electrical cord therein;

a fan motor assembly installed in the appliance chamber of the case for forcedly sucking the air into the appliance chamber and discharging the air;

an exhaust duct installed between the fan motor assembly and a discharge port in the case for guiding air discharged from the fan motor assembly to the discharge port; and a flowing passage disposed between the dust chamber and the cord chamber so that the air is able to flow therebetween.

2. A vacuum cleaner comprising:

a case including a duct chamber for filtering dust included in air, and an appliance chamber communicating with the dust chamber;

a fan motor assembly installed inside the appliance chamber of the case for sucking the air from inside the dust chamber and discharging the air outside the case through a discharge port of the case; and an exhaust duct installed between the fan motor assembly and the discharge port of the case, for guiding air discharged from the fan motor assembly to the discharge port, wherein the exhaust duct is formed by exhaust duct walls which are independent of outer walls forming the case of the vacuum cleaner, such that a path of flow of the air discharged from the fan motor assembly follows a path of the exhaust duct and does not follow a contour of the outer walls forming the case of the vacuum cleaner.

3. The vacuum cleaner according to claim 2, wherein exhaust ports are formed in a peripheral surface of the fan motor assembly, and the exhaust duct extends from the peripheral surface of the fan motor assembly to the discharge pout.

4. The vacuum cleaner according to claim 2, wherein an acoustically absorbent member is installed between the fan motor assembly and the exhaust duct.

5. The vacuum cleaner according to claim 2, wherein exhaust ports are formed in a rear surface of the fan motor assembly, and the exhaust duct extends from the rear surface of the fan motor assembly to the discharge port.

6. The vacuum cleaner according to claim 2, wherein a filter holder is formed at the discharge port of the case so that an exhaust filter can be installed thereat, and the exhaust duct is fixed over the filter holder.

* * * * *